US010058899B1

(12) United States Patent
Park

(10) Patent No.: US 10,058,899 B1
(45) Date of Patent: Aug. 28, 2018

(54) SHOE BRUSH AND CLEANING DEVICE

(71) Applicant: Hyun C. Park, Seal Beach, CA (US)

(72) Inventor: Hyun C. Park, Seal Beach, CA (US)

(73) Assignees: Hyun C. Park, Seal Beach, CA (US); Joseph H. Park, Anchorage, AK (US); Jeniffer Kang, Cerritos, CA (US)

( * ) Notice: Subject to any disclaimer, the term of this patent is extended or adjusted under 35 U.S.C. 154(b) by 0 days.

(21) Appl. No.: 15/847,504

(22) Filed: Dec. 19, 2017

(51) Int. Cl.

| | |
|---|---|
| ***A46B 13/02*** | (2006.01) |
| ***B08B 1/04*** | (2006.01) |
| ***B08B 1/00*** | (2006.01) |
| ***A46B 17/08*** | (2006.01) |
| ***B65D 21/02*** | (2006.01) |
| ***A46B 15/00*** | (2006.01) |

(52) U.S. Cl.
CPC ..... *B08B 1/04* (2013.01); *A46B 13/02* (2013.01); *A46B 15/0091* (2013.01); *A46B 17/08* (2013.01); *B08B 1/002* (2013.01); *B65D 21/0223* (2013.01); *A46B 2200/306* (2013.01)

(58) Field of Classification Search
CPC B08B 1/04; B08B 1/002; A46B 13/02; A46B 15/0091; A46B 17/08; B65D 21/0223
See application file for complete search history.

(56) References Cited

U.S. PATENT DOCUMENTS 5,450,646 A * 9/1995 McHugh ..... A46B 13/02 15/179
2008/0202549 A1* 8/2008 Weiss ..... A46B 7/023 132/328

FOREIGN PATENT DOCUMENTS

JP 08056749 A * 3/1996

* cited by examiner

*Primary Examiner* — Shay Karls
(74) *Attorney, Agent, or Firm* — Lucem, PC; Heedong Chae

(57) ABSTRACT

A cleaning device includes a spinning brush assembly that cleans the item; an electric motor to actuate the spinning brush assembly; a battery to power the electric motor; a first switch to turn on and off the electric motor; a housing that receives the electric motor and battery and provides a pair of protruding ribs to further receive brushes constructed to be received therein; and a sleeve that is detachably attached to the housing covering the housing and the pair of ribs. The cleaning device further includes first container and one or more second containers in which the first and second containers are attachable by threaded coupling means and snugly received in the sleeve.

20 Claims, 10 Drawing Sheets

70

10

SHOE BRUSH AND CLEANING DEVICE

CROSS-REFERENCE TO RELATED APPLICATIONS

Not applicable.

FIELD OF THE INVENTION

The present invention relates to a cleaning device having a motorized spinning assembly, a plurality of brushes, and a plurality of containers, and more particularly, a shoe cleaning device having a motorized spinning assembly, a plurality of brushes, a plurality of shoe polish containers, and a light emitting device.

BACKGROUND OF THE INVENTION

Cleaning devices come in at wildly varying degrees of shapes, sizes, user friendliness, convenience and cost. These variables hold true in realm of electric shoe cleaning and polishing devices. Before the advent of electric shoe polishers, manual shining of shoes was often a cumbersome and messy task. To address this issue, electric shoe polishers eventually arrived on the market. Early prototypes were largely geared towards businesses rather than individuals due to their cost, their large size footprint, or both.

Since then there has been a trend towards engineering these cleaning devices to be smaller. With respect to electric shoe polishers, there has been a dramatic evolution that has brought the power of devices that once took up a sizeable portion of a room manned by trained professionals to the palm of one hand of a lay individual. Still, while present day electric shoe cleaning devices can be handled by hand, many of them lack the convenience of carrying most of the necessary cleaning supplies in one device from one location to another. Indeed, it may be cumbersome to carry the necessary number of shoe polish containers, cleaning fabrics, brush types and any other cleaning supplies between locations. To permit such items to be carried with the cleaning device, one may be required to have an additional carrying bag or purchase a bulkier electric cleaning device to account for the added load. Both solutions add more hindrance to a user without solving the need of having a cleaning device with sufficient storage capacity without sacrificing the added convenience of present-day compact electric cleaning devices.

Therefore, to solve the above problems and provide individuals with a convenient way to clean and polish their shoes, there is a need for an electric shoe polishing device to provide the sufficient storage space to carry cleaning supplies together with having a compact size and a convenient shape for easy carry. This invention is directed to solve these problems and satisfy the long-felt need.

SUMMARY OF THE INVENTION

The present invention contrives to solve the disadvantages of the prior art. The present invention provides a cleaning device having not only a spinning assembly used to clean items but also the storage capacity to carry brushes, containers and other cleaning supplies to clean a variety of items, particularly shoes, in a compact cleaning device. The cleaning device is designed to be opened and closed via a detachable sleeve allowing for the exchange and storage of brushes and containers used for cleaning.

The object of the invention is to provide a cleaning device which includes a spinning assembly for cleaning an item having a shaft, an electric motor for actuating the shaft, a battery to power the electric motor, a first switch to turn on and off the electric motor, a housing including a pair of ribs, a brush constructed to be received in between the pair of ribs, a sleeve constructed to cover the housing and the pair of ribs, and an attachment means to detachably attach the sleeve to the housing. The attachment means may include coupled screw threads, snap-in attachments, interlocking attachments or the equivalents thereof.

Another object of the invention is to provide a cleaning device which includes a spinning brush assembly, an electric motor, a battery to power the electric motor, a first switch to turn on and off the electric motor, a housing including a brush receiving means in which the brush receiving means is formed on or attached to an outer surface of the body, a brush constructed to be received in or attached to the brush receiving means, a sleeve constructed to cover the housing and the brush receiving means, and an attachment means to detachably attach the sleeve to the housing.

The advantages of the present invention are: (1) the cleaning device of the present invention has sufficient storage capacity to carry much of the necessaries associated with cleaning, particularly shoe cleaning, from one location to another; (2) the cleaning device of the present invention has a motorized spinning assembly, a plurality of brushes, and a plurality of shoe polish containers which are necessary for cleaning shoes, and a number of cleaning items that can be carried together where the items are less likely to be missing or get lost; (3) the cleaning device of the present invention has a compact and integrated structure, and thus it is easy and convenient to carry and use; (4) brushes of the present invention have a unique curvature structure and such structure is advantageous in cleaning remote areas of a shoe and snugly fitting into the cleaning device; (5) the cleaning device of the present invention including a plurality of light emitting devices to allow unobstructed and detailed cleaning that would otherwise be missed in normal or low lighting conditions or in the corners and crevices of the article being cleaned; (6) the cleaning device of the present invention has a simple and integrated structure making it convenient to manufacture and keeping the manufacturing cost low; (7) the cleaning device of the present invention has containers of various sizes that permit other items to be stored therein including medical pills, various liquids, a mini-emergency case, first aid items, small tools, personal effects and shoe polish; (8) the cleaning device of the present invention has a sleeve that is securely attached to the housing to permit safe and easy carrying of the invention; (9) the cleaning device of the present invention includes the spinning assembly permitting different cleaning means attachments for any particular cleaning jobs other than cleaning shoes; (10) the cleaning device of the present invention has a brush with a profile where the brush can be angled to clean difficult corners and edges of the shoe or other household items; and (11) the present invention has various brushes, shoe polish containers, and light emitting device, and thus, it is especially advantageous in cleaning shoes, boots, safety boots, sport shoes such as golf shoes, or the likes, and removing dust, mud, slog or the likes.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
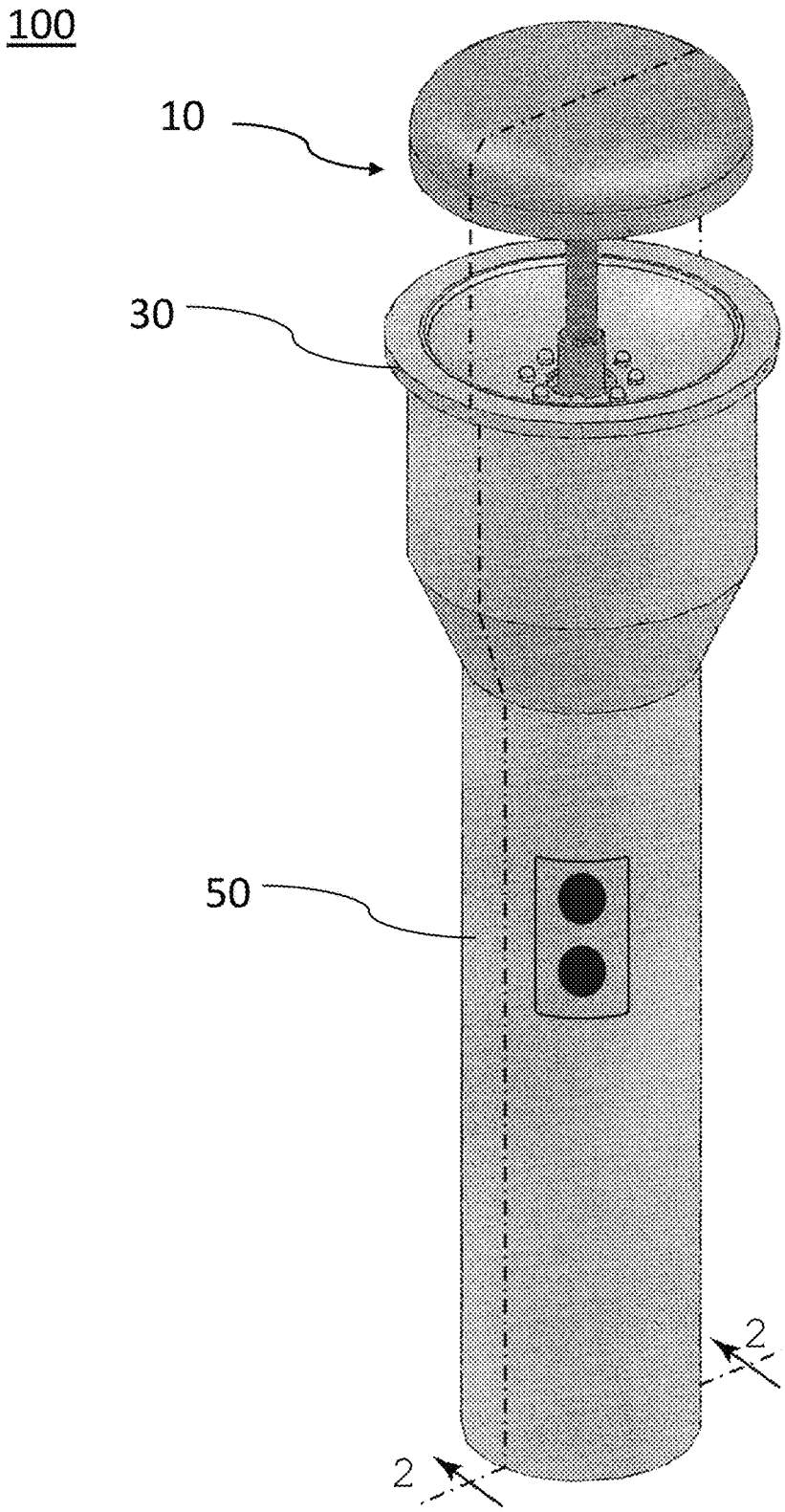
FIG. 1 shows a perspective view of the cleaning device wherein a housing of the cleaning device is enclosed in a sleeve according to one embodiment of the invention.
Figure 2:
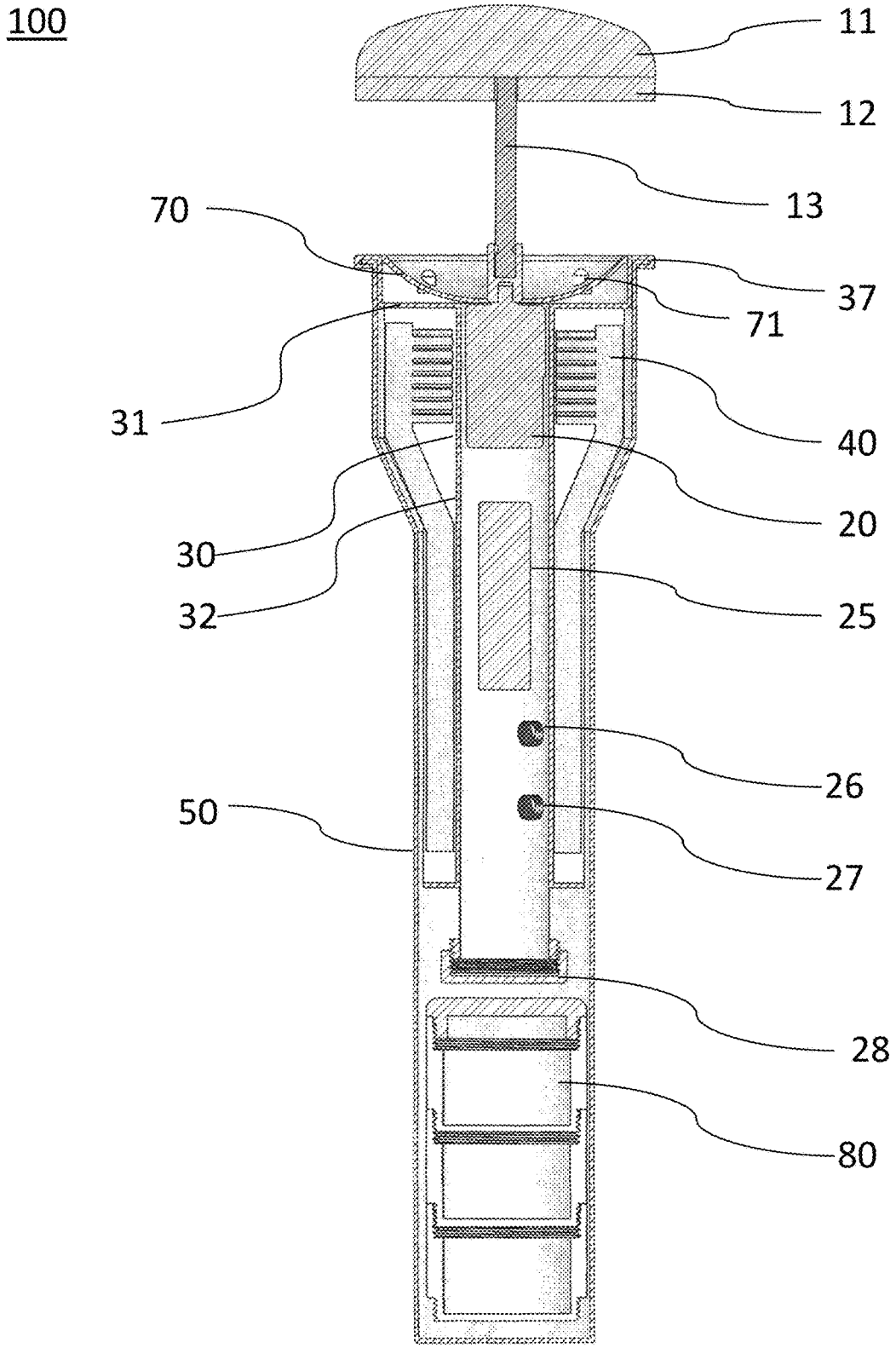
FIG. 2 shows a sectional view of the cleaning device according to one embodiment of the invention.

FIG. 1 shows a perspective view of the cleaning device 100 according to one embodiment of the present invention. FIG. 2 shows a sectional view of the cleaning device 100 according to one embodiment of the present invention.

The cleaning device 100 of the present invention includes a spinning assembly 10 for cleaning an item which comprises a cleaning means 11, a base 12, and a shaft 13; an electric motor 20 for actuating the shaft 13 wherein one end of the shaft 13 is attached to the base 12 and the other end of the shaft 13 is attached to the electric motor 20; a battery 25 to power the electric motor 20; a first switch 26 to turn on and off the electric motor 20; a housing 30 which comprises a head 31, a body 32, and a pair of ribs 33, 34 wherein the electric motor 20 and the battery 25 are received in the body 32 and the pair of ribs 33, 34 protrude from an outer surface of the body 32; a brush 40 constructed to be received in between the pair of ribs 33, 34; a sleeve 50 constructed to cover the body 32 and the pair of ribs 33, 34; and an attachment means 60 to detachably attach the sleeve 50 to the housing 30.

The cleaning means 11 may include a fabric-laden cushion or firmer material designed to hold different types of fabric or items such as wool, nylon, or cotton that may attach thereon to be applied to the article being cleaned. Types of fabrics may include cotton of varying quality and firmness: hard, medium or soft. Other items that may attach to the cleaning means include grinding paper, sand paper, different types of brush material, bristles, cloths (e.g. microfiber or other cleaning implements) or their equivalents. The spinning assembly 10 is replaceable with another spinning assembly 10 with another cleaning means 11 and can even be replaced with a driver or drill.

The interchangeability of the fabrics or items attached to the cleaning means permits the cleaning device to clean a variety of different articles including bottles, cups, countertops, flat or curved screens (television or computers), shoes, or, with the appropriate attachment, sanding wood.

The spinning assembly 10 includes the cleaning means 11, the base 12, and the shaft 13. As discussed earlier, the cleaning means 11 may hold a number of different fabrics and materials used for a variety of different cleaning tasks. Furthermore, the base 12 may be detachable from the shaft 13 via a screw thread coupling to allow easy replacement of the base 12 or overlying cleaning means 11 should they become damaged, or simply an easy swap of different cleaning means 12 made from different materials.

Figure 3:
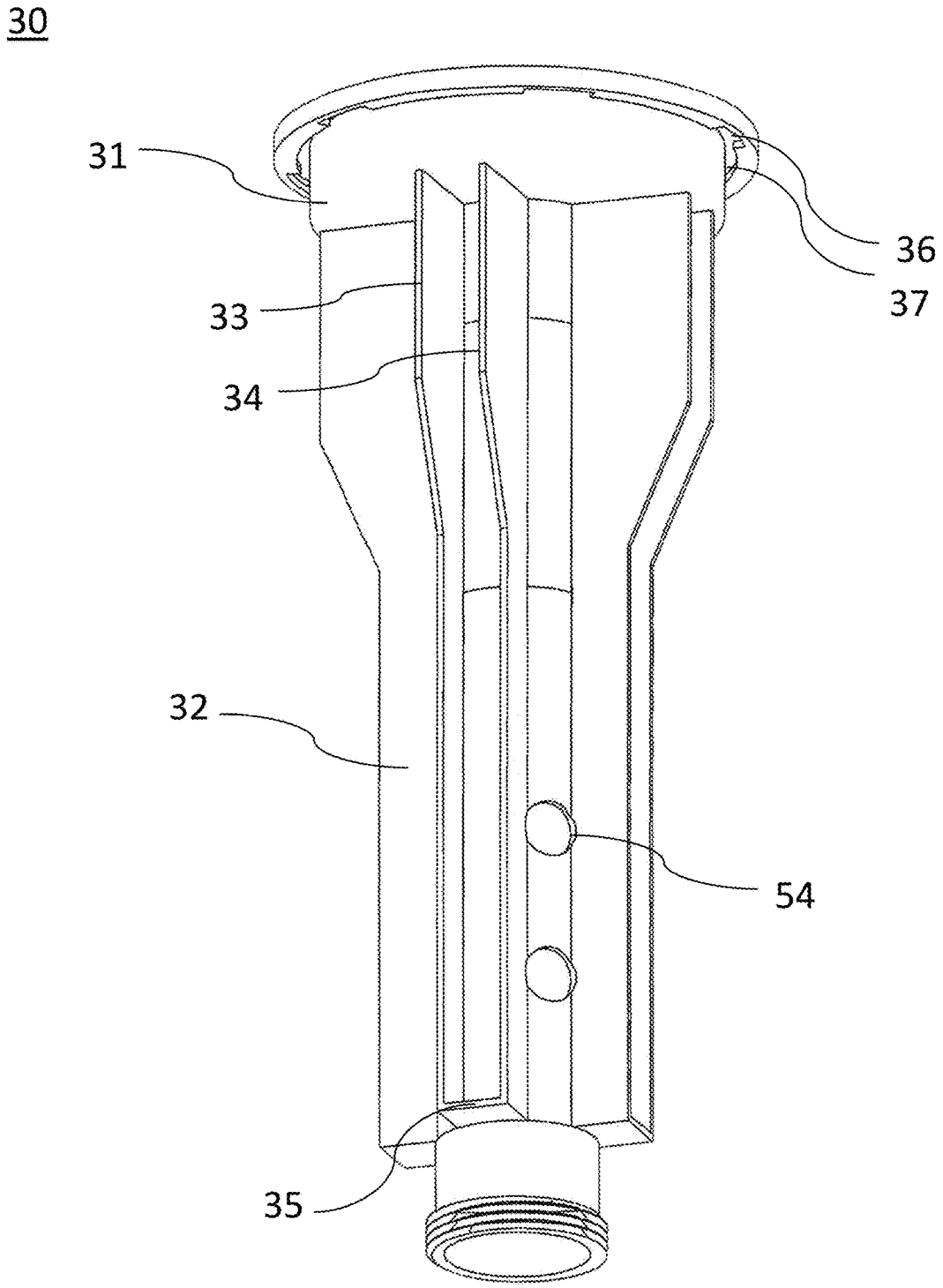
FIG. 3 shows a perspective view of the housing of the cleaning device according to one embodiment of the invention.
Figure 4:
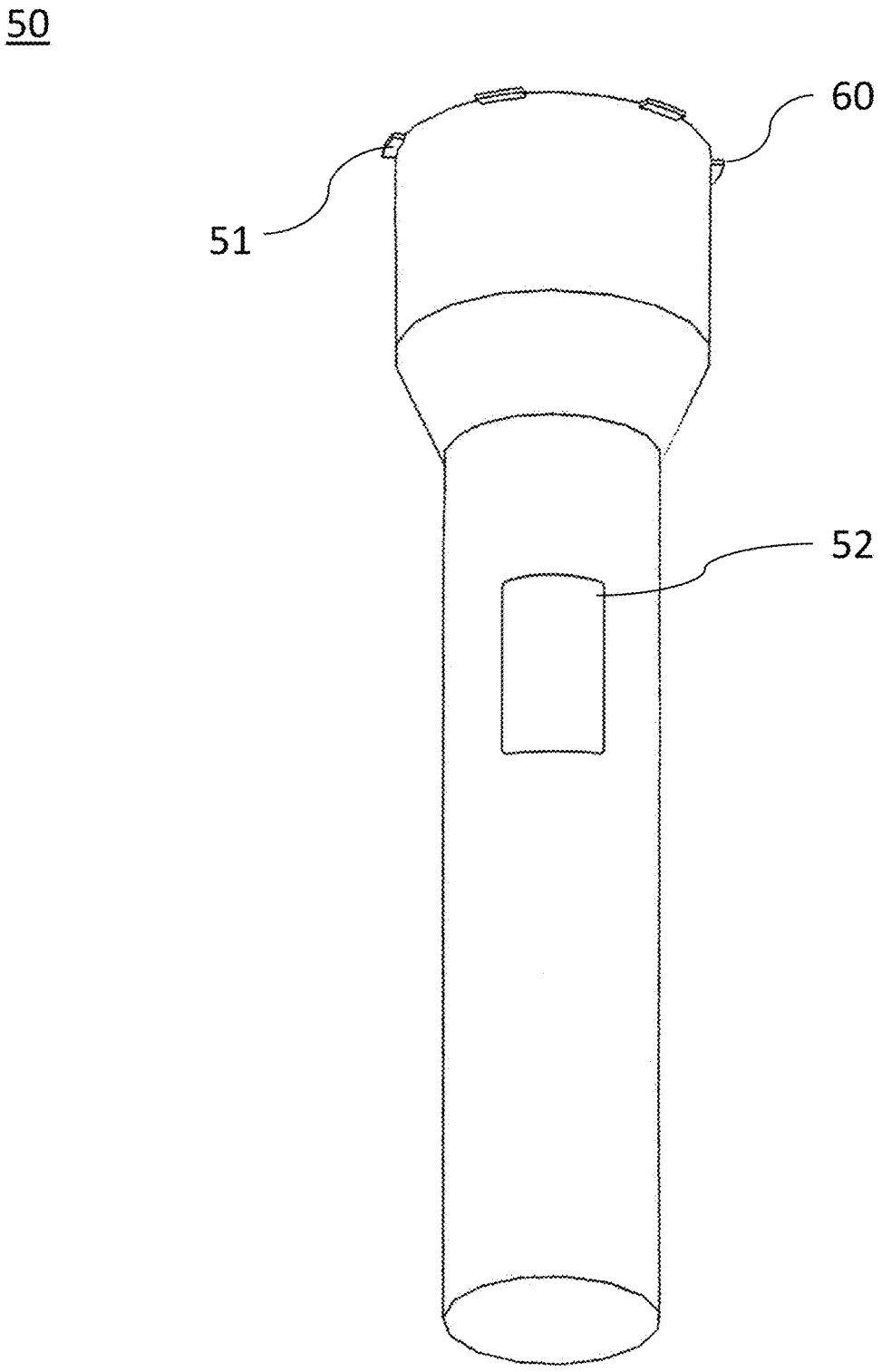
FIG. 4 shows a perspective view of the sleeve of the cleaning device according to one embodiment of the invention.
Figure 6:
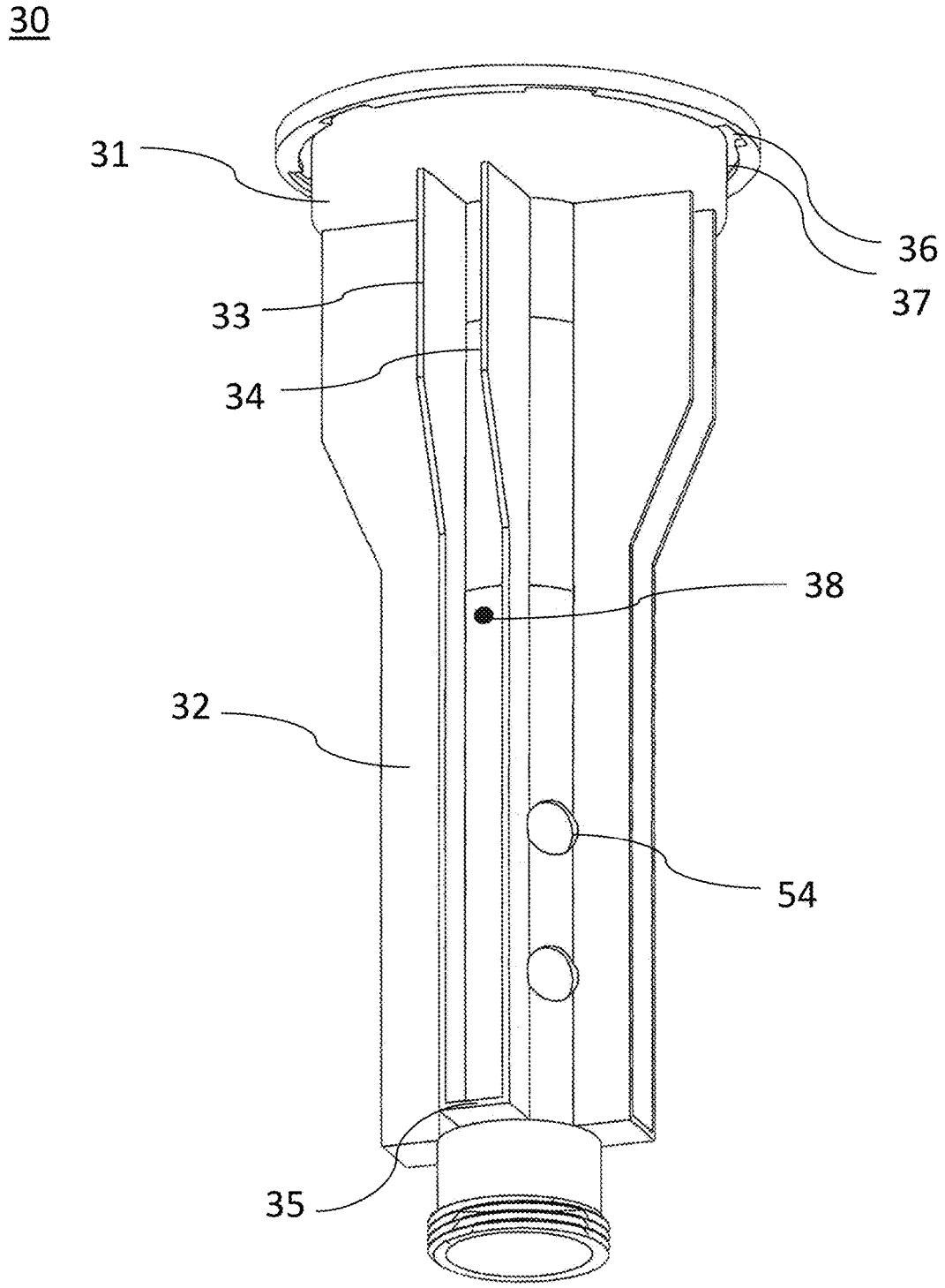
FIG. 6 shows a perspective view of the housing of the cleaning device according to one embodiment of the invention.

FIGS. 3 and 6 show perspective views of the housing of the cleaning device according to one embodiment of the invention, and FIG. 4 shows a perspective view of the sleeve of the cleaning device according to one embodiment of the invention.

The housing 30 may further include a tab 35 protruding from the outer surface of the body 32 such that the pair of ribs 33, 34, the head 31, and the tab 35 form a space to receive the brush 40 therein as shown in FIG. 3.

The housing 30 may comprise two or more pairs of ribs 33, 34 and the cleaning device 100 may comprise two or more brushes 40 as well such that each pair of ribs 33, 34 receive each brush 40 therein. In addition, two or more tabs 35 may extend from the body and the head 31 of the housing 30 circumferentially extends from the body 32 of the housing 30 such that each pair of ribs 33, 34, each tab 35, and the head 31 of the housing 30 form a space to receive each brush 40. Alternatively, the tab 35 may circumferentially extend from the outer surface of the body 32.

Preferably, the housing 30 may comprise four pairs of ribs 33, 34 and the cleaning device 100 may comprise four brushes 40 so that each pair of ribs 33, 34 are spaced about ninety degrees from adjacent pair of ribs 33, 34 as shown in FIG. 3.

A switch hole 52 may be formed on the sleeve 50 as in FIG. 4 to make the first and second switches 26, 27 accessible through the switch hole 52. There may be one switch hole 54 for both first and second switches 26, 27, or there may be two switch holes 54 respectively for first and second switches 26, 27. Additionally, the body 32 has switch hole or switch holes as well as shown in FIG. 3. The first and second switches 26, 27 are preferable formed on the outer surface of the body 32 in between the pairs of the ribs 33, 34.

The attachments means 60 may comprise a projection 51, a cavity 36, and a groove 37 in that the projection 51 is formed on the sleeve 50 and the cavity 36 and the groove 37 are formed on the head 31 of the housing 30. The sleeve 50 is attached to the housing 30 by inserting the projection 51 into the cavity 36 and rotating the sleeve 50 or the housing 30 so that the projection 51 is at least partially aligned with the groove 37.

In the alternative embodiment, the attachments means 60 may comprise a pair of threaded coupling means, one of which is formed on the sleeve 50 and the other of which is formed on the housing 30, preferably on the head 31 of the housing 30.

In a preferred embodiment, the body 32 of the housing 30 and the sleeve 50 are substantially cylindrical, and the pair of ribs 33, 34 snugly fit in the sleeve 50. Furthermore, the cleaning device 100 further comprises first and second containers 80, 90 and the first and second containers 80, 90 are cylindrical and snugly received in the sleeve 50 as well. The body 32, the sleeve 50 and the containers 80, 90 may alternatively be octagonal, hexagonal, or regular polygonal to permit a snug fit.

The housing 30 may further include a closing 28 towards the end the body 32 of the housing located opposite to the head 31 of the housing 30.

FIG. 4 shows a perspective view of the sleeve 50 of the present invention. The sleeve 50 includes an attachment means 60 and a switch hole 32. The switch hole 32 may be large enough to permit access to one or two switches. Additionally, the sleeve 50 may include additional frictional material on its outer surface to add friction for increased grip stability.

FIG. 6 shows a perspective view of the housing 30 of the invention for another embodiment which includes the head 31, the body 32, the pair of ribs 33, 34 protruding from the outer surface of the body, the tab 35 in between the ribs 33, 34 and a brush receiving means 38. The brush receiving means 38 may include an annular bead or a snap joint coupled to a receiving recess on the brush 40 or the brush handle 43. Alternatively, the brush receiving means 38 is formed on the brush 40 and the recess is formed on the body 32.

Figure 5:
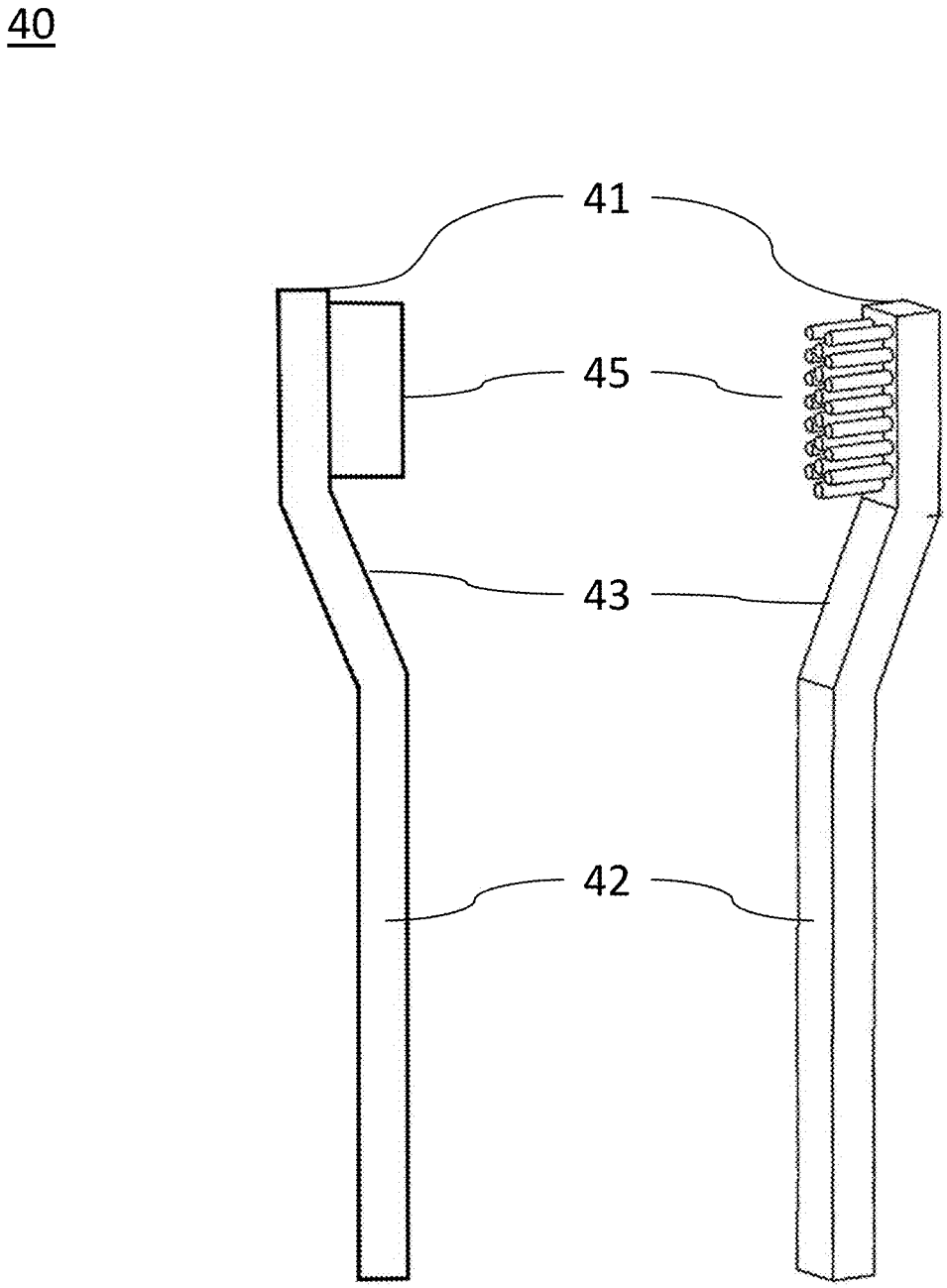
FIG. 5 shows front and perspective views of the brush that can be stored in and retrieved from the housing of the cleaning device.

FIG. 5 shows front and perspective views of the brush that can be stored in and retrieved from the housing of the cleaning device.

Preferably, the brush 40 comprises a head 41, a handle 42, and a neck 43 in that bristles 45 are attached to the head 41 and the neck 43 connects the head 41 and the handle 42 of the brush 40. The head 41 and the handle 42 of the brush 40 are longitudinal and substantially on the same plane, namely, coplanar. The head 41 and the handle 42 may be substantially parallel with each other. The bristles 45 are located substantially in between the head 41 and the handle 42 of the brush 40. In this structure, the brush 40 can be angled to clean difficult corners and edges of the shoe or other household items.

The head 41 and the handle 42 of the brush 40 can also be coplanar or substantially parallel with each other. The bristles 44 may be made from horse hair, plastic, regular hair or wire, iron brush, tooth brush, or their equivalents. Furthermore, the brush 40 is constructed to be received in the space between the pair of ribs 33, 34 in a snug fit.

The pair of ribs 33, 34 run longitudinally along the outer surface of the body 32 of the housing 30 and are raised higher toward the head 31 of the housing 30 to receive the head 41 and the bristles 45 of the brush 40. Preferably, the profile of the brush 40 substantially corresponds to the pair of ribs 33, 34 such that the brush 40 snugly fits in between the pair of ribs 33, 34.

For secure attachment of the brush 40 to the body 32 of the housing 30, the brush 40 may comprise a recess (not shown) to receive a protrusion 38 protruding from the outer surface of the body 32 between the pair of ribs 33, 34. The handle 42 of the brush 40 may comprise a recess to receive at least one snapping means protruding from the outer surface of the body 32 and the snapping means may be located between the pair of ribs 33, 34 such that the brush 40 snaps into and snugly fits in between the pair of ribs 33, 34. Alternatively, a pair of the protrusions 38 may be formed on each of the ribs 33, 34 and recesses may be formed on the brush 40 at corresponding locations.

Figure 7A:
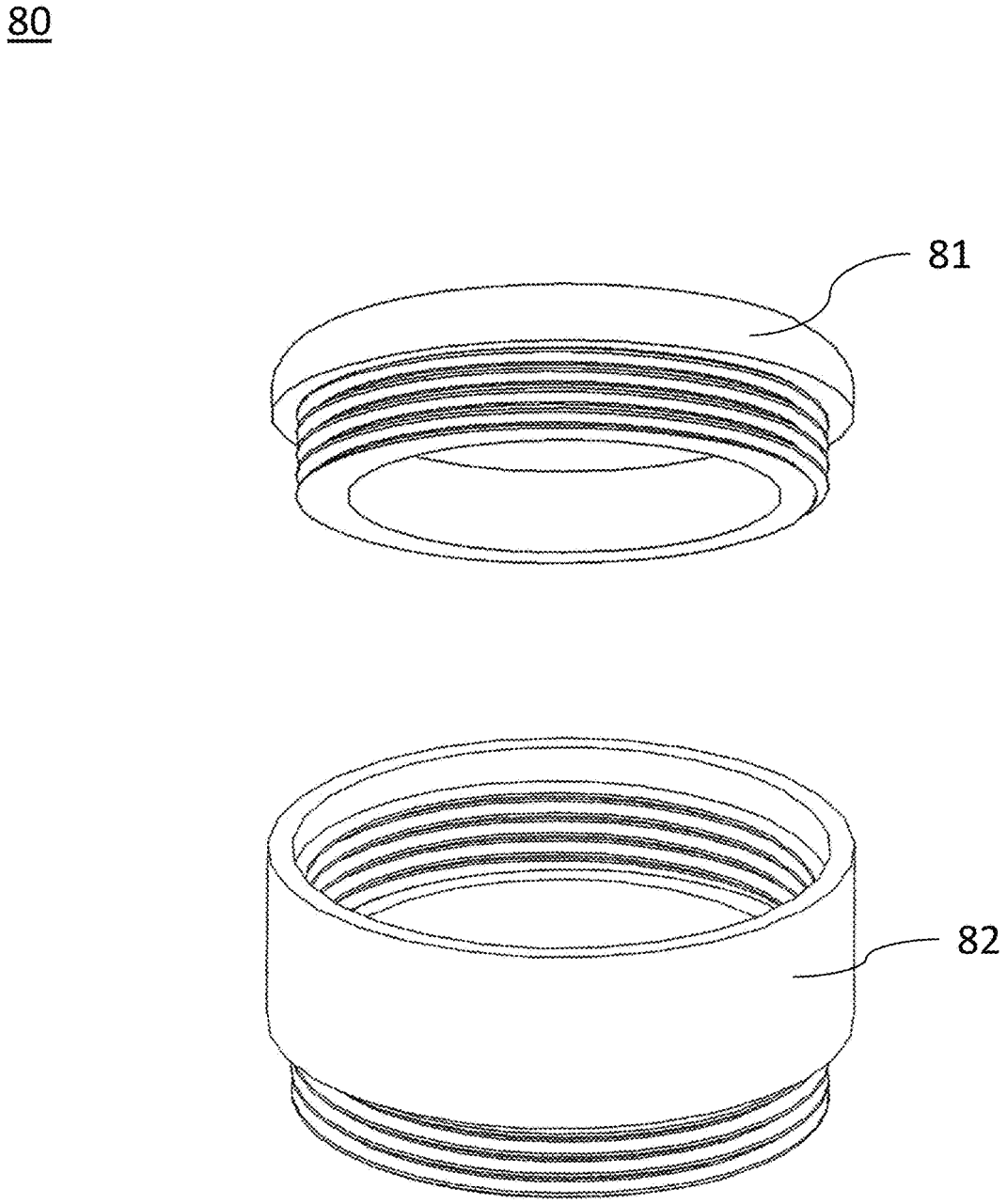
FIG. 7A shows a perspective view of the first container of the cleaning device.
Figure 7B:
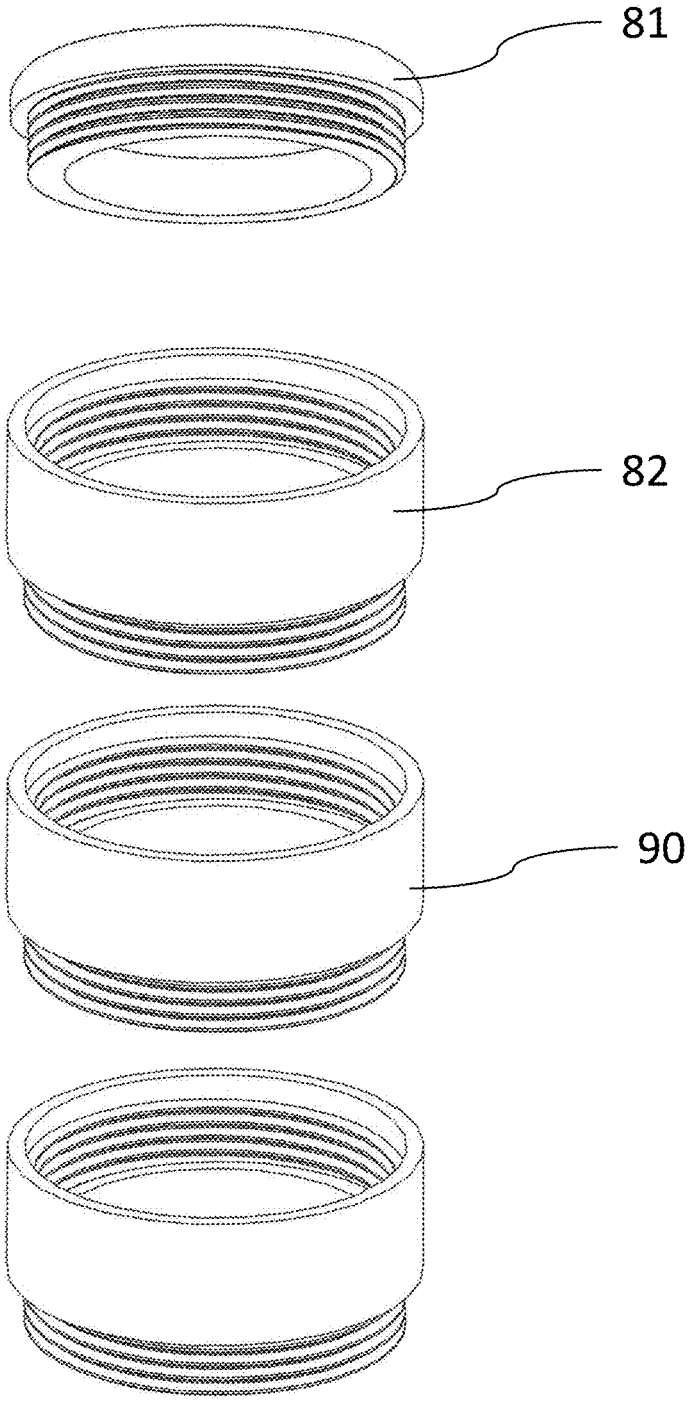
FIG. 7B shows an exploded perspective view of the first and second containers of the cleaning device.

FIG. 7A shows a perspective view of the first container of the cleaning device, and FIG. 7B shows an exploded perspective view of the first and second containers of the cleaning device.

The cleaning device 100 may further comprise a first container 80 constructed to store shoe polish wherein the first container 80 comprises a lid 81 and a body 82. The body 82 may have threaded coupling means on top and bottom of the body 82 wherein the lid 81 is constructed to be attachable to the body 82 by the threaded coupling means. The first container 80 is sized to be snugly received in the sleeve 50. The first container 80 may be constructed to be attachable to the body 32 by threaded attachment means or any other attachment means.

The cleaning device 100 may further comprise a second container 90 constructed to store shoe polish wherein the second container 90 has threaded coupling means on top and bottom of the body. The threaded coupling means on top of the second container 90 is constructed to be coupled with the threaded coupling means on bottom of the body of the first container 80, and the threaded coupling means on bottom of the second container is constructed to be coupled with additional container 90. The second container 90 is sized to be snugly received in the sleeve 50. The coupling means of the containers 80, 90 is preferably threaded coupling means, but it may be interlocking coupling means, snap in coupling means or any other means known in the art.

The containers 80, 90 may be housed singly or in series via the threaded coupling means, and then received in the sleeve 50. The threaded coupling means for the containers 80, 90 may include a screw thread of the opposite gender to the screw thread contained in the body of the container 82, an interlocking joint between the lid 81 and container 80 or between the first container 80 to the second container 90, a snap-in coupling between the first container 80 and the lid 81 or between the second container 90 to the first container 80, or their equivalents. The containers 80, 90 may contain shoe polish in different colors.

Additionally, the container 80 needs not to carry only shoe polish. With containers potentially being of variable size, and thus volumes, a container 80 can hold any number of items including personal items, first aid items, small tools, medical pills, liquids, a mini-emergency case, or shoe polish.

The sleeve 50 covering the body 32 of the housing 30 may be transparent so that the brushes 40 are visible, and a grip may be formed or attached to the sleeve 50 at the portion covering the containers 80, 90.

Figure 8:
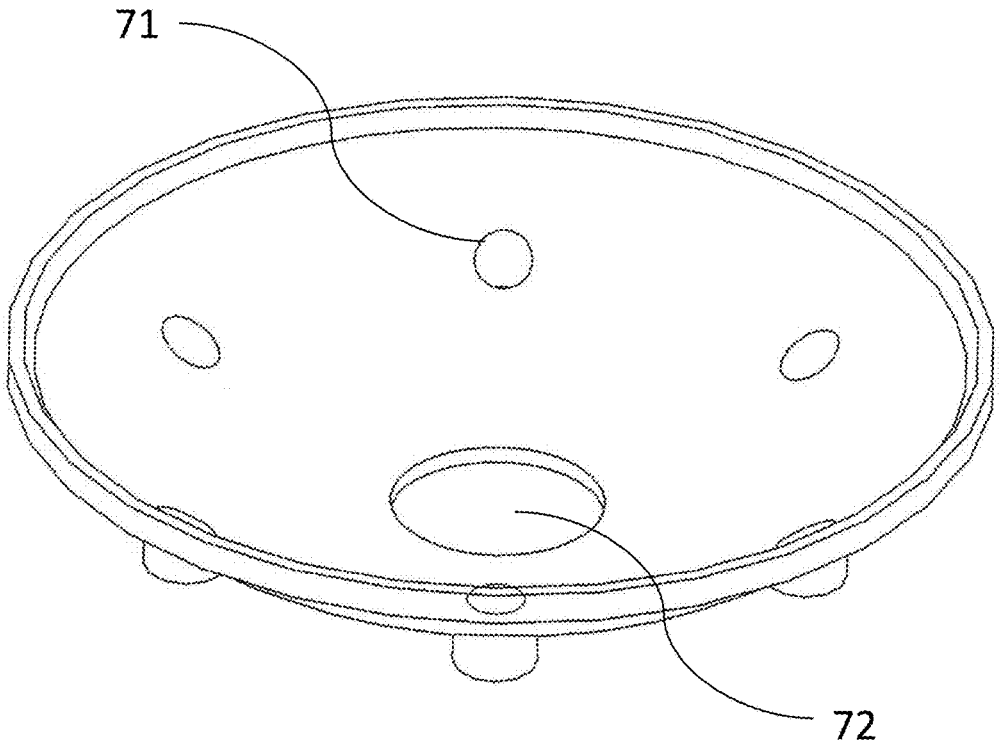
FIG. 8 shows a perspective view of the cap of the cleaning device.
Figure 9:
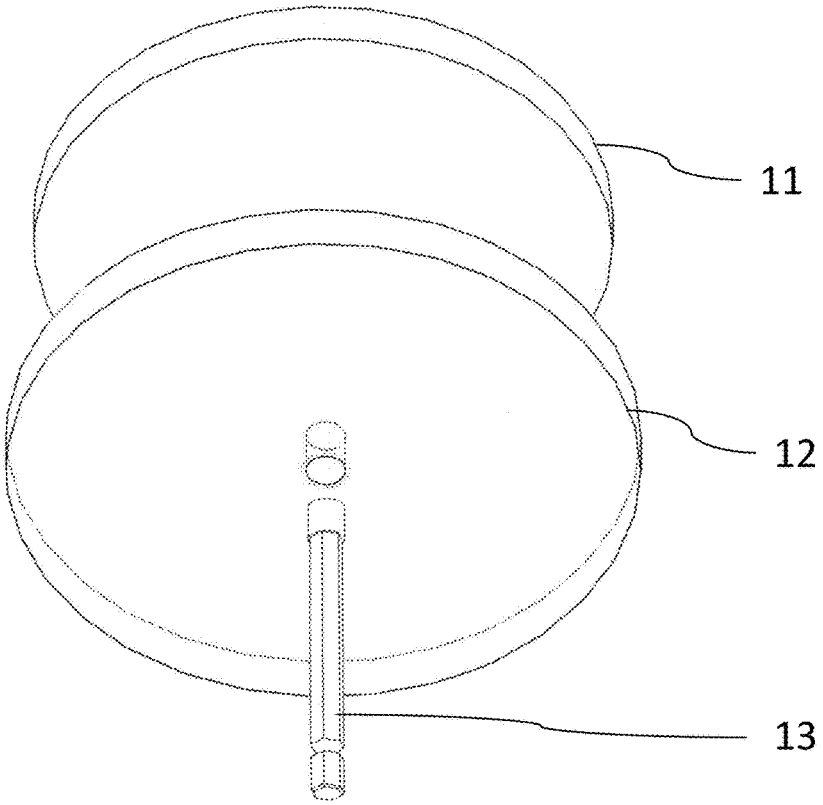
FIG. 9 shows an exploded view of a spinning assembly of the cleaning device.

FIG. 8 shows a perspective view of the cap of the cleaning device. FIG. 9 shows an exploded view of a spinning assembly of the cleaning device.

The cleaning device 100 may further comprise a cap 70, a plurality of light emitting devices 71 such as light emitting diode or the likes, and a second switch 27 to turn on and off the plurality of light emitting devices. The cap 70 is received in the head 31 of the housing 30 and the plurality of light emitting devices 71 are installed on the cap 70. Accordingly, the cleaning device 100 can be used as a flash light and can be used to light remote dark areas to clean.

Preferably, the cap 70 is concavely curved, having a reflective surface, and the cap 70 has a hole 72 about a center of the cap 70 so that the shaft 13 passes through the hole 72.

In the alternative embodiment, the cleaning device 100 of the present invention may comprise: a spinning assembly 10 which comprises a cleaning means 11, a base 12, and a shaft 13; an electric motor 20 for actuating the shaft 13 wherein one end of the shaft 13 is attached to the base 12 and another end of the shaft 13 is attached to the electric motor 20; a battery 25 to power the electric motor 20; a first switch 26 to turn on and off the electric motor 20; a housing 30 which comprises a head 31, a body 32, and a brush receiving means 38 wherein the electric motor 20 and the battery 25 are received in the body 32 and the brush receiving means 38 is formed on or attached to an outer surface of the body 32; a brush 40 constructed to be received in or attached to the brush receiving means 38; a sleeve 50 constructed to cover the body 32 and the brush receiving means 38; and an attachment means 60 to detachably attach the sleeve 50 to the housing 30. The brush receiving means 38 receives the brush 40 or holds the brush 40.

The brush receiving means 38 may be a groove formed on an outer surface of the body 32. The brush 40 comprises a head 41, a handle 42, and a neck 43 in that bristles 45 are attached to the head 41 and the neck 43 connects the head 41 and the handle 42 of the brush 40. The head 41 and the handle 42 of the brush 40 are longitudinal and substantially on the same plane, and the bristles 45 are located substantially in between the head 41 and the handle 42 of the brush 40. The profile of the brush 40 substantially corresponds to the groove such that the brush 40 snugly fits in the groove.

Alternatively, the brush receiving means 38 may be a holding means formed on or extending from the body 32 of the housing 30 wherein the holding means is constructed to hold the brush 40.

In the alternative embodiment, the brush receiving means 38 may be a groove formed by a pair of ribs 33, 34 protruding from the outer surface of the body 32, a snap-in bead-groove coupling, a holding cradle for the brush 40, or their equivalents.

The attachment means 60 may include a screw thread on the housing mating with the screw thread of the opposite gender on the sleeve, an interlocking joint, a snap joint, an annular snap-fit bead-groove coupling, their equivalents or any combination thereof. It must be noted though that care must be taken when attaching the sleeve to the housing, especially if the attachment means is a mating between two screw threads. Specifically, the screw threads should be aligned in the proper direction relative to the direction of the spinning assembly; in other words, in a manner that the housing and sleeve should tighten further when the spinning assembly is turned on.

While the invention has been shown and described with reference to different embodiments thereof, it will be appreciated by those skilled in the art that variations in form, detail, compositions and operation may be made without departing from the spirit and scope of the invention as defined by accompanying claims.

What is claimed is:

1. A cleaning device (100), comprising:

a spinning assembly (10) for cleaning an item which comprises a cleaning means (11), a base (12), and a shaft (13);

an electric motor (20) for actuating the shaft (13) wherein one end of the shaft (13) is attached to the base (12) and the other end of the shaft (13) is attached to the electric motor (20);

a battery (25) to power the electric motor (20);

a first switch (26) to turn on and off the electric motor (20);

a housing (30) which comprises a head (31), a body (32), and a pair of ribs (33, 34) wherein the electric motor (20) and the battery (25) are received in the body (32) and the pair of ribs (33, 34) protrude from an outer surface of the body (32);

a brush (40) constructed to be received in between the pair of ribs (33, 34);

a sleeve (50) constructed to cover the body (32) and the pair of ribs (33, 34); and an attachment means (60) to detachably attach the sleeve (50) to the housing (30).

2. The cleaning device (100) of claim 1, wherein the brush (40) comprises a head (41), a handle (42), and a neck (43), wherein bristles (45) are attached to the head (41) and the neck (43) connects the head (41) and the handle (42) of the brush (40), wherein the head (41) and the handle (42) of the brush (40) are longitudinal and substantially on the same plane, and wherein the bristles (45) are located substantially in between the head (41) and the handle (42) of the brush (40).

3. The cleaning device (100) of claim 2, wherein the pair of ribs (33, 34) run longitudinally along the outer surface of the body (32) of the housing (30) and are raised higher toward the head (31) of the housing (30) to receive the head (41) and the bristles (45) of the brush (40).

4. The cleaning device (100) of claim 3, wherein a profile of the brush (40) substantially corresponds to the pair of ribs (33, 34) such that the brush (40) snugly fits in between the pair of ribs (33, 34).

5. The cleaning device (100) of claim 1, wherein the brush (40) comprises a recess (not shown) to receive a protrusion (38) protruding from the outer surface of the body (32) between the pair of ribs (33, 34).

6. The cleaning device (100) of claim 1, wherein the housing (30) further comprises a tab (35) protruding from the outer surface of the body (32) wherein the pair of ribs (33, 34), the head (31), and the tab (35) form a space to receive the brush (40) therein.

7. The cleaning device (100) of claim 1, wherein the housing (30) comprises two or more pairs of ribs (33, 34) and the cleaning device (100) comprises two or more brushes (40) wherein each pair of ribs (33, 34) receive each brush (40) therein, and wherein two or more tabs (35) extends from the body and the head (31) of the housing (30) circumferentially extends from the body (32) of the housing (30), wherein each pair of ribs (33, 34), each tab (35), and the head (31) of the housing (30) form a space to receive each brush (40).

8. The cleaning device (100) of claim 7, wherein the housing (30) comprises four pairs of ribs (33, 34) and the cleaning device (100) comprises four brushes (40) wherein each pair of ribs (33, 34) are spaced about ninety degrees from adjacent pair of ribs (33, 34).

9. The cleaning device (100) of claim 1, further comprising a cap (70), a plurality of light emitting devices (71), and a second switch (27) to turn on and off the plurality of light emitting devices wherein the cap (70) is received in the head (31) of the housing (30) and the plurality of light emitting devices (71) are installed on the cap (70).

10. The cleaning device (100) of claim 9, wherein the cap (70) is concavely curved, having a reflective surface, and wherein the cap (70) has a hole (72) about a center of the cap (70) so that the shaft (13) passes through the hole (72).

11. The cleaning device (100) of claim 9, wherein a switch hole (52) is formed on the sleeve (50) to make the first and second switches (26, 27) accessible through the switch hole (52).

12. The cleaning device (100) of claim 1, wherein the attachments means (60) comprises a projection (51), a cavity (36), and a groove (37) wherein the projection (51) is formed on the sleeve (50) and the cavity (36) and the groove (37) are formed on the head (31) of the housing (30), and wherein the sleeve (50) is attached to the housing (30) by inserting the projection (51) into the cavity (36) and rotating the sleeve (50) or the housing (30) so that the projection (51) is at least partially aligned with the groove (37).

13. The cleaning device (100) of claim 1, wherein the attachments means (60) comprises a pair of threaded coupling means, one of which is formed on the sleeve (50) and the other of which is formed on the housing (30).

14. The cleaning device (100) of claim 13, further comprising a second container (90) constructed to store shoe polish wherein the second container (90) has threaded coupling means on top and bottom of the body, wherein the threaded coupling means on top of the second container (90) is constructed to be coupled with the threaded coupling means on bottom of the body of the first container (80), wherein the threaded coupling means on bottom of the second container is constructed to be coupled with additional container (90), wherein the second container (90) is sized to be snugly received in the sleeve (50).

15. The cleaning device (100) of claim 1, further comprising a first container (80) constructed to store shoe polish wherein the first container (80) comprises a lid (81) and a body (82) wherein the body (82) has a threaded coupling means on top and bottom of the body wherein the lid (81) is constructed to be attachable to the body (82) by the threaded coupling means, wherein the first container (80) is sized to be snugly received in the sleeve (50).

16. The cleaning device (100) of claim 1, wherein the body (32) of the housing (30) and the sleeve (50) are substantially cylindrical, and the pair of ribs (33, 34) snugly fit in the sleeve (50), wherein the cleaning device (100) further comprises first and second containers (80, 90) and the first and second containers (80, 90) are cylindrical and snugly received in the sleeve (50).

17. A cleaning device (100), comprising:

a spinning assembly (10) which comprises a cleaning means (11), a base (12), and a shaft (13);

an electric motor (20) for actuating the shaft (13) wherein one end of the shaft (13) is attached to the base (12) and another end of the shaft (13) is attached to the electric motor (20);

a battery (25) to power the electric motor (20);

a first switch (26) to turn on and off the electric motor (20);

a housing (30) which comprises a head (31), a body (32), and a brush receiving means (38) wherein the electric motor (20) and the battery (25) are received in the body (32) and the brush receiving means (38) is formed on or attached to an outer surface of the body (32);

a brush (40) constructed to be received in or attached to the brush receiving means;

a sleeve (50) constructed to cover the body (32) and the brush receiving means (38); and an attachment means (60) to detachably attach the sleeve (50) to the housing (30).

18. The cleaning device (100) of claim 17 wherein the brush receiving means (38) is a groove formed on an outer surface of the body (32).

19. The cleaning device (100) of claim 18, wherein the brush (40) comprises a head (41), a handle (42), and a neck (43), wherein bristles (45) are attached to the head (41) and the neck (43) connects the head (41) and the handle (42) of the brush (40), wherein the head (41) and the handle (42) of the brush (40) are longitudinal and substantially on the same plane, wherein the bristles (45) are located substantially in between the head (41) and the handle (42) of the brush (40), wherein a profile of the brush (40) substantially corresponds to the groove such that the brush (40) snugly fits in the groove.

20. The cleaning device (100) of claim 17, wherein the brush receiving means is a holding means formed on or extending from the body (32) of the housing (30) wherein the holding means is constructed to hold the brush (40).

* * * * *